US011882986B2

(12) United States Patent
Hsu et al.

(10) Patent No.: US 11,882,986 B2
(45) Date of Patent: Jan. 30, 2024

(54) FLOOR TYPES IDENTIFYING DEVICE, DUST SUCTION DEVICE HAVING THE SAME, AND VACUUM CLEANER HAVING THE SAME

(71) Applicant: TALENTONE HONG KONG LIMITED, Hong Kong (CN)

(72) Inventors: Chia-Chang Hsu, Hsinchu County (TW); Fu-Yuen Fong, Hong Kong (CN); Kwok Lit Chan, Hong Kong (CN)

(73) Assignee: TALENTONE HONG KONG LIMITED, Hong Kong (CN)

( * ) Notice: Subject to any disclaimer, the term of this patent is extended or adjusted under 35 U.S.C. 154(b) by 0 days.

(21) Appl. No.: 17/692,183

(22) Filed: Mar. 11, 2022

(65) Prior Publication Data

US 2022/0296065 A1 Sep. 22, 2022

(30) Foreign Application Priority Data

Mar. 17, 2021 (CN) ..... 202110283331.0

(51) Int. Cl.
*A47L 9/28* (2006.01)
*A47L 5/36* (2006.01)
(Continued)

(52) U.S. Cl.
CPC ..... *A47L 9/2831* (2013.01); *A47L 5/362* (2013.01); *A47L 9/0411* (2013.01);
(Continued)

(58) Field of Classification Search
CPC .... A47L 9/2831; A47L 9/0411; A47L 9/0477; A47L 9/248; A47L 9/2826; A47L 9/2847; A47L 5/362
(Continued)

(56) References Cited

U.S. PATENT DOCUMENTS 11,202,543 B2 * 12/2021 Pohlman ..... A47L 9/0411
2005/0065662 A1 * 3/2005 Reindle ..... A47L 9/2889 701/1

(Continued)

FOREIGN PATENT DOCUMENTS

DE 102015100353 A1 * 7/2016
EP 1997412 B1 * 10/2012 ..... A47L 9/0081

(Continued)

OTHER PUBLICATIONS

Search Report for foreign counterpart application EP22161104.9, dated Aug. 11, 2022.

*Primary Examiner* — Brian D Keller
*Assistant Examiner* — Robert C Moore

(57) ABSTRACT

A floor types identifying device for use in a vacuum cleaner is disclosed, and comprises a current sensing unit coupled and a processing and controlling module. When a suction head is moved, a driving current of a roller brush driving motor is detected by the current sensing unit, such that the processing and controlling module judges that the suction head is moved on a specific floor that has a hard surface, a short-pile-carpeted surface or a long-pile-carpeted surface according to a variation of the driving current. Therefore, for a vacuum cleaner that is integrated with the floor types identifying device of the present invention, both suction power of the vacuum cleaner and driving power of the roller driving motor can be properly adjusted in response to the floor's surficial material type.

14 Claims, 10 Drawing Sheets

(51) Int. Cl.
*A47L 9/04* (2006.01)
*A47L 9/24* (2006.01)

(52) U.S. Cl.
CPC ..... *A47L 9/0477* (2013.01); *A47L 9/248* (2013.01); *A47L 9/2826* (2013.01); *A47L 9/2847* (2013.01)

(58) Field of Classification Search
USPC ..... 15/319
See application file for complete search history.

(56) References Cited

U.S. PATENT DOCUMENTS

| | | | | |
|---|---|---|---|---|
| 2018/0351483 | A1* | 12/2018 | Arisawa | H02M 7/53873 |
| 2020/0315418 | A1 | 10/2020 | Howard et al. | |
| 2022/0304534 | A1* | 9/2022 | Terry | A47L 11/4072 |

FOREIGN PATENT DOCUMENTS

| | | | | |
|---|---|---|---|---|
| EP | 3235414 | A1 * | 10/2017 | |
| EP | 3473153 | | 4/2019 | |
| TW | 698214 | | 7/2020 | |
| WO | 2018161011 | | 9/2018 | |
| WO | WO-2021006671 | A1 * | 1/2021 | A47L 9/2857 |

* cited by examiner

FLOOR TYPES IDENTIFYING DEVICE, DUST SUCTION DEVICE HAVING THE SAME, AND VACUUM CLEANER HAVING THE SAME

BACKGROUND OF THE INVENTION

1. Field of the Invention

The present invention relates to the technology field of vacuum cleaners, and more particularly to a floor types identifying device for use in a dust suction device of a vacuum cleaner.

2. Description of the Prior Art

Vacuum cleaner has become a necessary household appliance in everyone else's family nowadays. FIG. 1 shows a stereo diagram of a conventional vacuum cleaner. As FIG. 1 shows, the conventional vacuum cleaner commonly comprises a machine body 11*a*, an extension connection unit 12*a* and a dust suction device 13*a*, wherein the dust suction device 13*a* comprises a suction head 132*a* and a connection unit 131*a* connected between the extension connection unit (tube) 12*a* and the suction head 132*a*. For satisfying various requirements of dust cleaning, home appliance manufacturers develops and provides many types of suction heads, including: suction head with bare floor brush, suction head with air driven roller brush, suction head with electrically-driven roller brush, and suction head using upholstery nozzle.

FIG. 2 illustrates a stereo diagram of the dust suction device of the vacuum cleaner as shown in FIG. 1. As FIG. 2 shows, the dust suction device 13*a* is one kind of suction head with electrically-driven roller brush, and comprises a roller brush 1321*a* and a roller brush driving motor 1322*a* that are integrated in the suction head 132*a*. When using the vacuum cleaner 1*a* to clean dust and/or debris on a floor's surface, the roller brush driving motor 1322*a* operates after receiving a driving current, so as to drive the roller brush 1321*a* to rotate for enhancing dust inhaling effect of the suction head 132*a*. However, practical experiences indicate that, the suction head 132*a* with electrically-driven roller brush is only suitable for sucking dust on hard surfaced floor, such as tile and wood floors. As FIG. 2 and FIG. 3 show, in case of the suction head 132*a* with electrically-driven roller brush being moved on a soft surfaced floor like a floor with short-pile-carpeted surface or a floor with a long-pile-carpeted surface, the pile fibers of the carpet may be entangled with the roller brush 1321*a*, causing that the suction head 132*a* fails to move on forward or backward due to the fact that the roller brush 1321*a* is jammed.

It is worth mentioning that, a vacuum cleaner having functionality of floor types identifying has been developed. For example, Taiwan Patent No. I698214 has disclosed a vacuum cleaner with floor detection function. Disclosures of the Taiwan Patent No. I698214 describe that an ultrasonic sensor or an optical sensor is disposed on the suction head as shown in FIG. 2 for achieving the floor types identification. Moreover, the suction head is further integrated with a height adjusting unit. By such arrangement, in case of the floor detection sensor detecting that the suction head is moved on a floor with short-pile-carpeted surface or a floor with long-pile-carpeted surface, the height adjusting unit is controlled by a control processor to lift up the suction head, thereby preventing the pile fibers of the carpet from being entangled with the roller brush. At the same time, the control processor also reduces the suction power of the vacuum cleaner motor.

Although the vacuum cleaner having functionality of floor types identifying has been developed, letting the floor detection sensor and the height adjusting unit be simultaneously integrated in the suction head still causes the manufacturing cost of the vacuum cleaner become higher. On the other hand, in spite of the fact that the control processor is enabled to adjust the suction power of the vacuum cleaner motor according to a detection signal received from the floor detection sensor, there is a lack of a reference signal or a enabling signal for control processor to adjust the driving power of the roller brush driving motor 1322*a* (as shown in FIG. 2). As a result, in case of the suction head 132*a* with electrically-driven roller brush being moved on a floor with short-pile-carpeted surface or a floor with long-pile-carpeted surface, the pile fibers of the carpet may be entangled with the roller brush 1321*a*, causing that the suction head 132*a* fails to move on forward or backward due to the fact that the roller brush 1321*a* is jammed.

From above descriptions, it is understood that there are still rooms for improvement in the conventional vacuum cleaner using suction head with electrically-driven roller brush. In view of that, inventors of the present application have made great efforts to make inventive research and eventually provided a floor types identifying device for use in a dust suction device of a vacuum cleaner.

SUMMARY OF THE INVENTION

The primary objective of the present invention is to disclose a floor types identifying device for use in a dust suction device of a vacuum cleaner. In which, the dust suction device comprises a suction head and an extension connection unit, and the suction head includes a roller brush and a roller brush driving motor. The floor types identifying device comprises a current sensing unit coupled to the roller brush driving motor and a processing and controlling module. In case of the suction head is moved, a driving current for controlling an operation of the roller brush driving motor is detected by the current sensing unit, such that the processing and controlling module is able to judge that the suction head is moved on a specific floor that has a hard surface, a short-pile-carpeted surface or a long-pile-carpeted surface according to a variation of a current sensing signal outputted from the current sensing unit. Therefore, besides easy to be implemented into any one type of vacuum cleaner, the floor types identifying device also shows advantages of simple structure and low cost. The most important thing is that, for a vacuum cleaner that is integrated with the floor types identifying device of the present invention, both suction power of the vacuum cleaner and driving power of the roller driving motor can be properly adjusted in response to the floor's surficial material type.

In order to achieve the primary objective of the present invention, inventors of the present invention provide an embodiment of the floor types identifying device, which is applied in a vacuum cleaner comprises a machine body, an extension connection unit and a dust suction device. In which, the dust suction device comprises a suction head and a connection unit connected between the suction head and the extension connection unit, and the dust suction device comprises a roller brush and a roller brush driving motor. The floor types identifying device comprises:

a first current sensing unit, being coupled to the roller brush driving motor, and is used to detect a first current for controlling an operation of the roller brush driving motor in case of the suction head being moved along a first direction, thereby outputting a first current sensing signal; and a controlling and processing module, being coupled to the first current sensing unit and the roller brush driving motor, and comprising:

a storage unit, being stored with a plurality of reference parameters that comprises: a base value, a first threshold value greater than the base value, a second threshold value greater than the first threshold value greater than, and a third threshold value greater than the second threshold value;

a first signal processing unit2, being coupled to the first current sensing unit for receiving the first current sensing signal, so as to process the first current sensing signal to a first signal; and a main controlling unit, being coupled to the storage unit and the first signal processing unit for receiving the first signal, and being configured to perform a plurality of functions, comprising:

(a) judging that the moved suction head is on a hard surfaced floor in case of a value of a first signal level of the first signal falling in a first zone that is defined by the base value and the first threshold value;

(b) judging that the moved suction head is on a floor with short-pile-carpeted surface in case of the value of the first signal level falling in a second zone that is defined by the first threshold value and the second threshold value; and (c) judging that the moved suction head is on a floor with long-pile-carpeted surface in case of the value of the first signal level falling in a third zone that is defined by the second threshold value and the third threshold value.

In one embodiment, the plurality of functions further comprise:

(d) stopping the operation of the roller brush driving motor in case of the value of the first signal level exceeding an overload limiting value.

In one embodiment, a direction sensor is also integrated in the suction head, and is used for detecting a forward-moving direction and a backward-moving direction of the suction head.

In a practicable embodiment, the direction sensor completes a moving direction detection of the suction head by detecting a rotation direction of an auxiliary wheel of the suction head.

In one embodiment, the controlling and processing module further comprises a second signal processing unit, wherein the second signal processing unit is coupled to the main controlling unit and the direction sensor for receiving a moving direction sensing signal, so as to process the moving direction sensing signal to a moving direction signal.

In one embodiment, the first current sensing unit detects a second current for controlling the operation of the roller brush driving motor in case of the suction head being moved along the second direction, and then the first signal processing unit processes the second current sensing signal to a second signal.

In a practicable embodiment, the plurality of reference parameters further comprise a first difference value, a second difference value and a third difference value, and the plurality of functions further comprise:

(e) judging that the moved suction head is on the hard surfaced floor in case of a value difference between a value of a second signal level of the second signal and the value of the first signal level being less than the first difference value;

(f) judging that the moved suction head is on the floor with short-pile-carpeted surface in case of the value difference being greater than the first difference value but less than the second difference value; and (g) judging that the moved suction head is on the floor with long-pile-carpeted surface in case of the value difference being greater than the second difference value but less than the third difference value.

In a practicable embodiment, the plurality of reference parameters further comprise a first level variation value, a second level variation value, a third level variation value, and a fourth level variation value.

In one practicable embodiment, the plurality of functions further comprise:

(h) judging that the moved suction head is moved from the hard surfaced floor into the floor with short-pile-carpeted surface in case of the suction head being moved along the first direction as well as the value of the first signal level falling in the first zone suddenly having a variation value greater than the first level variation value; and (i) judging that the moved suction head is moved from the floor with short-pile-carpeted surface into the floor with long-pile-carpeted surface in case of the suction head being moved along the first direction as well as the value of the first signal level falling in the second zone suddenly having a variation value greater than the second level variation value.

In another one practicable embodiment, the plurality of functions further comprise:

(j) judging that the moved suction head is moved from the floor with long-pile-carpeted surface into the floor with short-pile-carpeted surface in case of the suction head being moved along the first direction as well as the value of the first signal level falling in the third zone suddenly having a variation value greater than the third level variation value; and (k) judging that the moved suction head is moved from the floor with short-pile-carpeted surface into the hard surfaced floor in case of the suction head being moved along the first direction as well as the value of the first signal level falling in the second zone suddenly having a variation value greater than the fourth level variation value.

In one embodiment, the floor types identifying device further comprises a second current sensing unit, which is coupled to a vacuum cleaner motor disposed in the machine body, and is used for detecting a driving current for controlling an operation of the vacuum cleaner motor.

Moreover, the present invention also discloses a dust suction device, which is included by a vacuum cleaner, and comprises a suction head and a connection unit disposed on the suction head. The dust suction device is characterized in that it further comprises a floor types identifying device according to the present invention.

In one embodiment, the dust suction device further comprises an air aspiration adjusting unit, which is disposed on the suction head or the connection unit, and is used for adjusting an amount of air aspiration in an air channel connected between an extension connection unit of the vacuum cleaner and the connection unit.

Furthermore, the present invention also discloses a vacuum cleaner comprising a machine body, an extension connection unit and a dust suction device according to the present invention.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe a floor types identifying device for use in a dust suction device of a vacuum cleaner disclosed by the present invention, embodiments of the present invention will be described in detail with reference to the attached drawings hereinafter.

Figure 1:
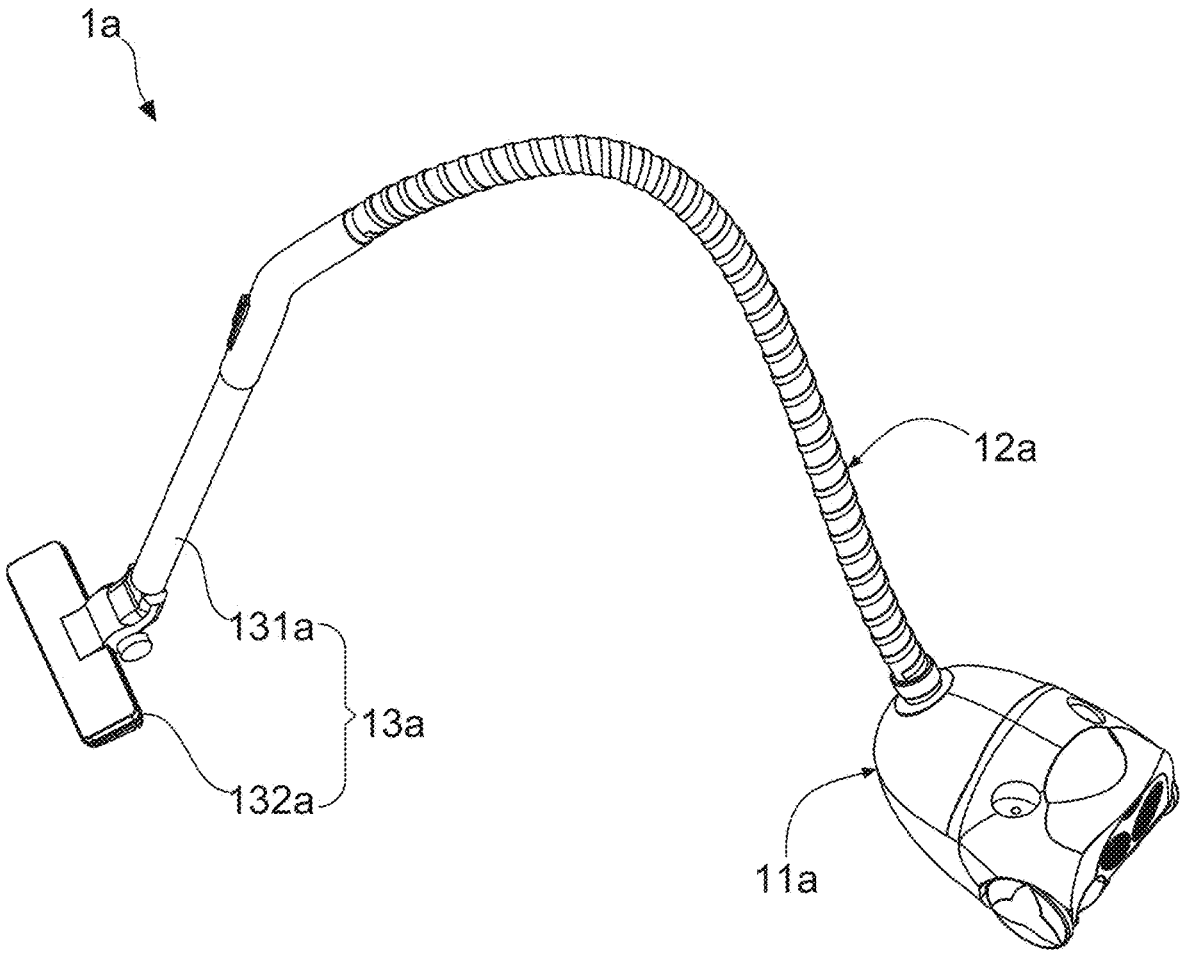
FIG. 1 shows a stereo diagram of a conventional vacuum cleaner.
Figure 2:
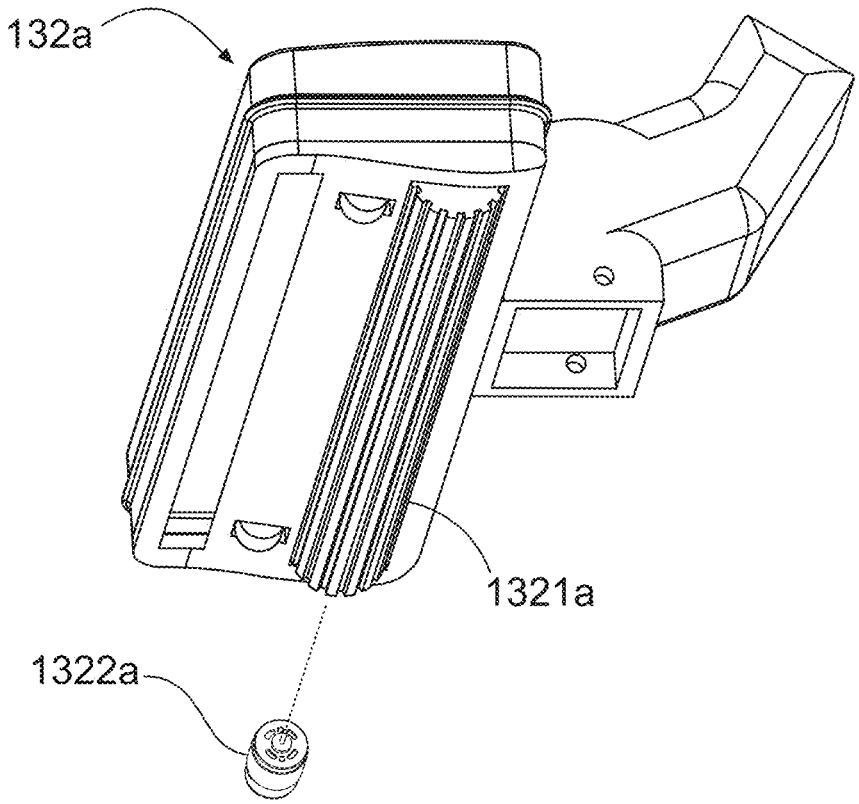
FIG. 2 shows a stereo diagram of a dust suction device of the vacuum cleaner as shown in FIG. 1.
Figure 3:
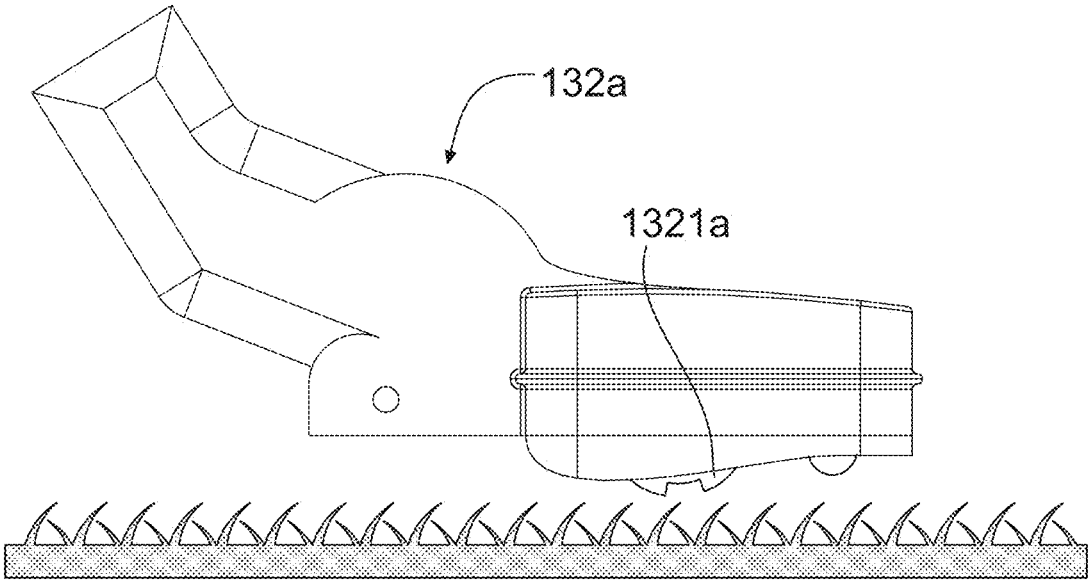
FIG. 3 shows a side view of the dust suction device of the vacuum cleaner as shown in FIG. 1.
Figure 4:
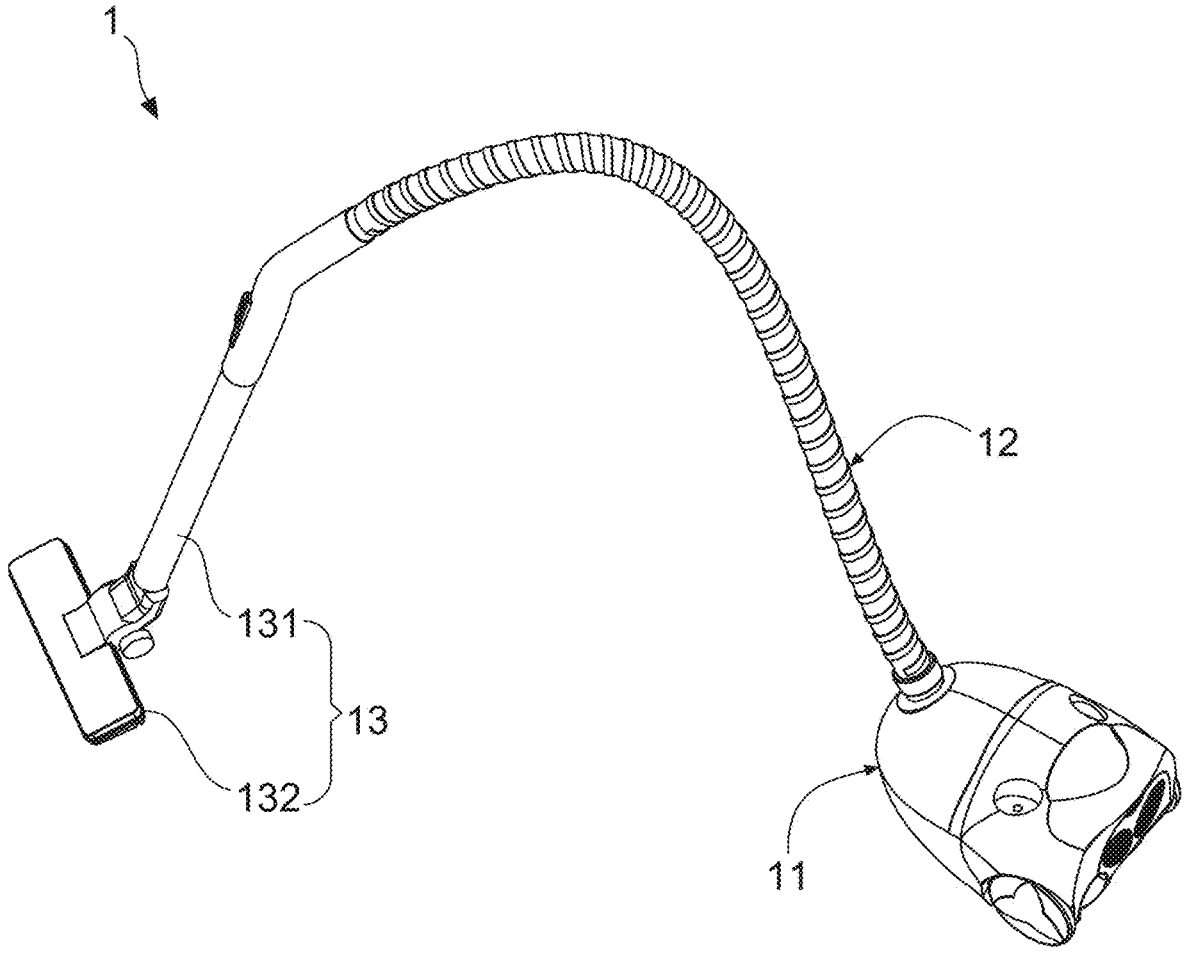
FIG. 4 shows a stereo diagram of a vacuum cleaner having a the floor types identifying device according to the present invention.
Figure 5:
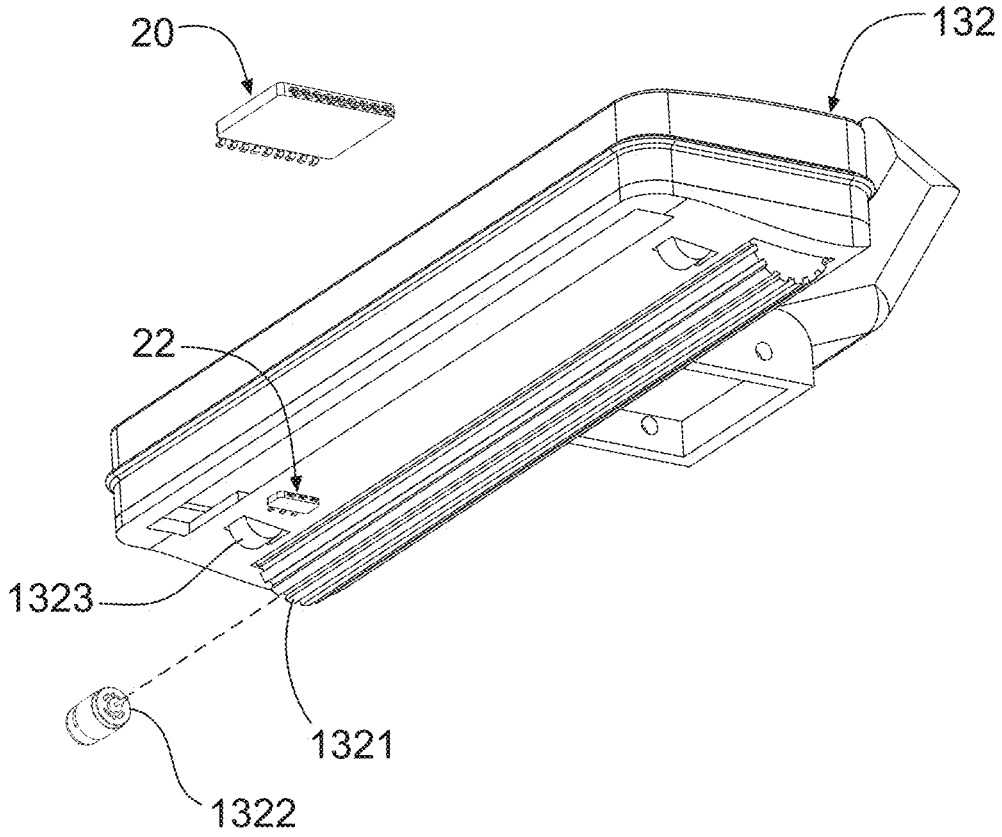
FIG. 5 shows a first stereo diagram of a dust suction device of the vacuum cleaner as shown in FIG. 4.

With reference to FIG. 4, there is shown a stereo diagram of a vacuum cleaner having a the floor types identifying device according to the present invention. As FIG. 4 shows, the vacuum cleaner 1 commonly comprises a machine body 11, an extension connection unit 12 and a dust suction device 13, wherein the dust suction device 13 comprises a suction head 132 and a connection unit 131 connected between the extension connection unit (tube) 12 and the suction head 132. FIG. 5 illustrates a first stereo diagram of the dust suction device of the vacuum cleaner as shown in FIG. 4. As FIG. 5 shows, the dust suction device 13 is one kind of suction head with electrically-driven roller brush, and comprises a roller brush 1321, and a roller brush driving motor 1322 and at least one direction of an auxiliary wheel 1323.

Figure 6:
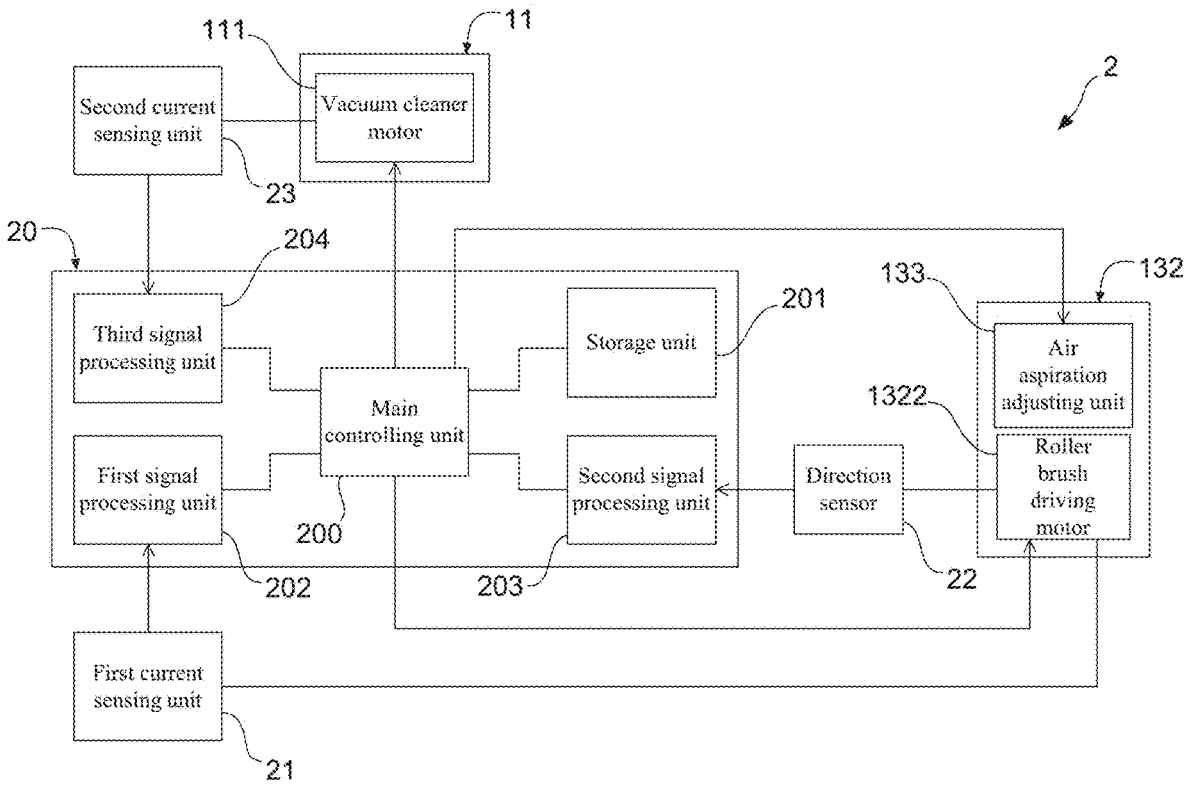
FIG. 6 shows a block diagram of the floor types identifying device according to the present invention.

With reference to FIG. 6, there is shown a block diagram of the floor types identifying device according to the present invention. As FIG. 5 and FIG. 6 show, the floor types identifying device 2 of the present invention mainly comprises: a first current sensing unit 21 and a controlling and processing module 20, wherein the controlling and processing module 20 mainly comprises: a storage unit 201, a main controlling unit 200, and a first signal processing unit 202. As explained in more detail below, the first current sensing unit 21 is coupled to the roller brush driving motor 1322, and is used to detect a first current (or a second current) for controlling an operation of the roller brush driving motor 1322 in case of the suction head 132 being moved along a first direction (or a second direction), thereby outputting a first current sensing signal (or a second current sensing signal). Moreover, the storage unit 201 is stored with a plurality of reference parameters that comprises: a base value, a first threshold value greater than the base value, a second threshold value greater than the first threshold value greater than, and a third threshold value greater than the second threshold value.

As described in more detail below, the first signal processing unit 202 is coupled to the first current sensing unit 21 for receiving the first current sensing signal (or the second current sensing signal), so as to process the first current sensing signal to a first signal (or a second signal). In one embodiment, the first signal processing unit 202 is an analog-to-digital convertor, such that the first signal and the second signal are both a digital signal. On the other hand, the main controlling unit 200 is coupled to the storage unit 201 and the first signal processing unit 202 for receiving the first signal.

Figure 7:
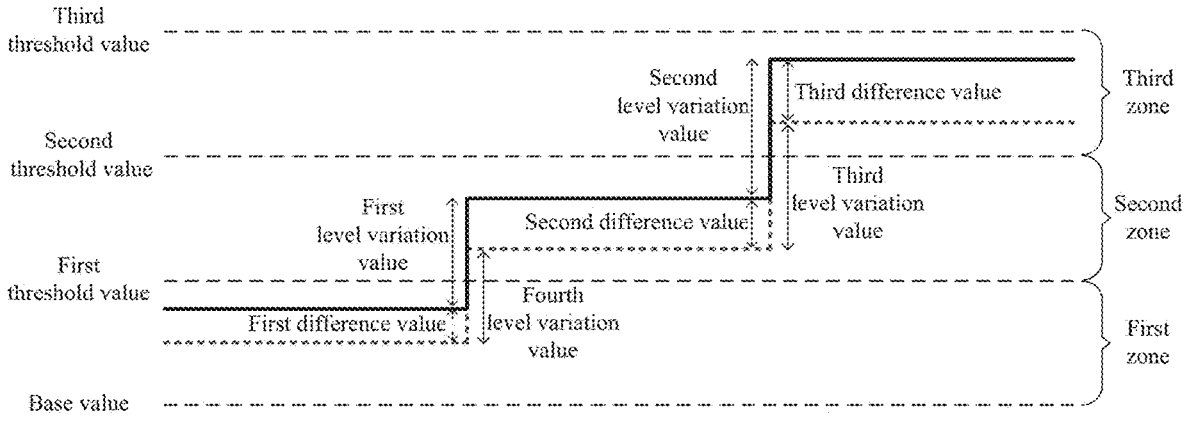
FIG. 7 shows a plot of reference curves for describing a plurality of reference values that is stored in a storage unit.
Figure 8A:
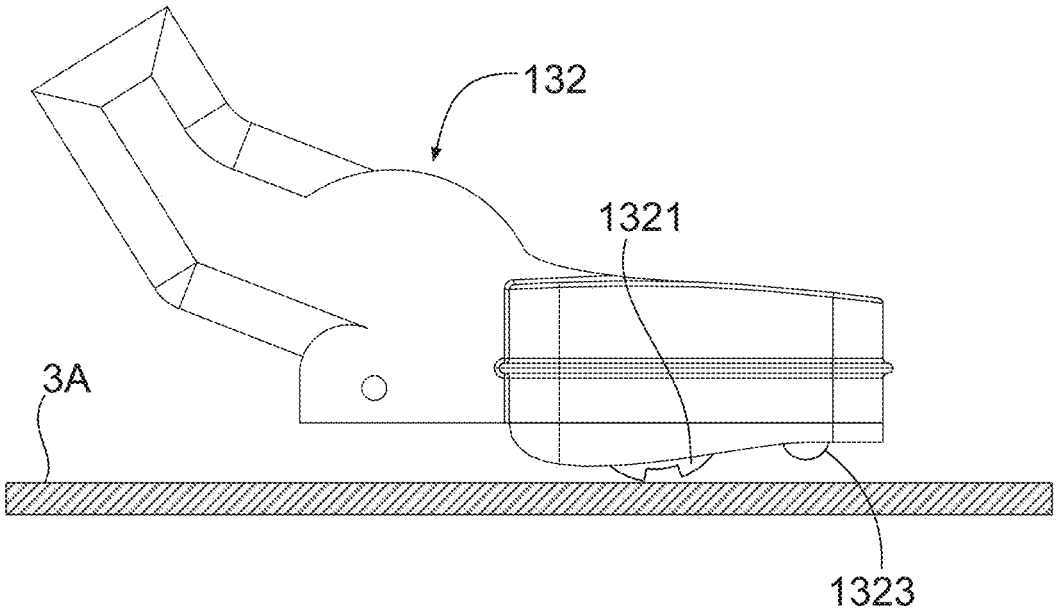
FIG. 8A shows a first side view of the dust suction device of the vacuum cleaner as shown in FIG. 4.

FIG. 7 shows a plot of reference curves for describing a plurality of reference values that is stored in a storage unit 201. Moreover, FIG. 8A illustrates a first side view of the dust suction device 13 of the vacuum cleaner 1 as shown in FIG. 4. According to the present invention, the main controlling unit 200 is coupled to the storage unit 201 and the first signal processing unit 202 for receiving the first signal. As FIG. 8A and the dark gray dotted curve of FIG. 7 show, the main controlling unit 200 is configured to perform a first function of (a) judging that the moved suction head 132 is on a hard surfaced floor 3A in case of a value of a first signal level of the first signal falling in a first zone that is defined by the base value and the first threshold value. In one embodiment, the base value can be defined by a value of a signal level of a driving current measured from the roller brush driving motor 1322 that is at an unoperated state.

For example, the base value is zero (mA). Of course, in another one embodiment, the base value can be a basic reference value, and can be defined by a value of a signal level of a driving current measured from the roller brush driving motor 1322 that is at a standby state.

Figure 8B:
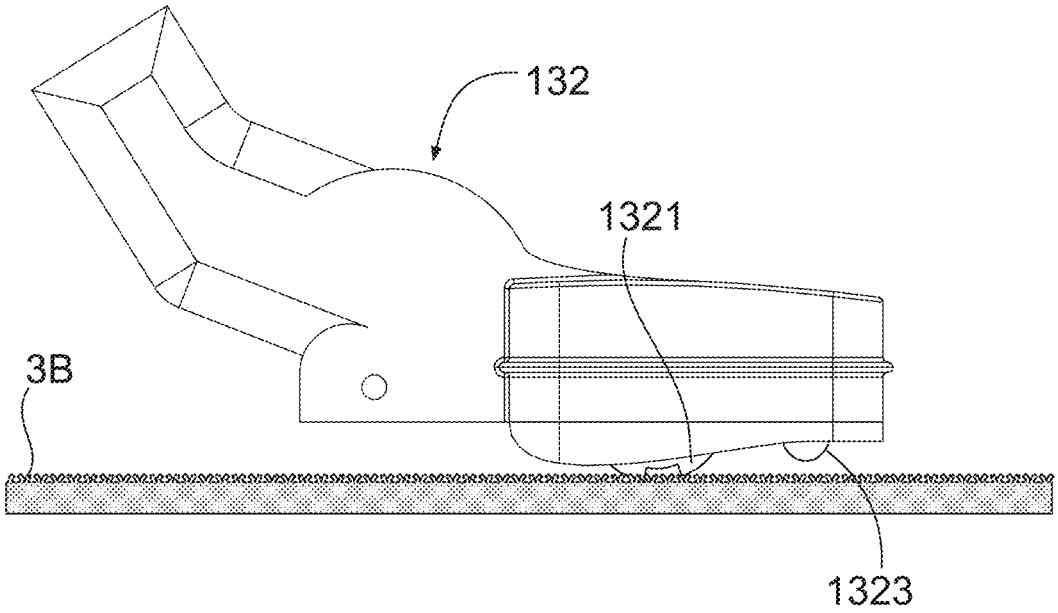
FIG. 8B shows a second side view of the dust suction device of the vacuum cleaner as shown in FIG. 4.
Figure 8C:
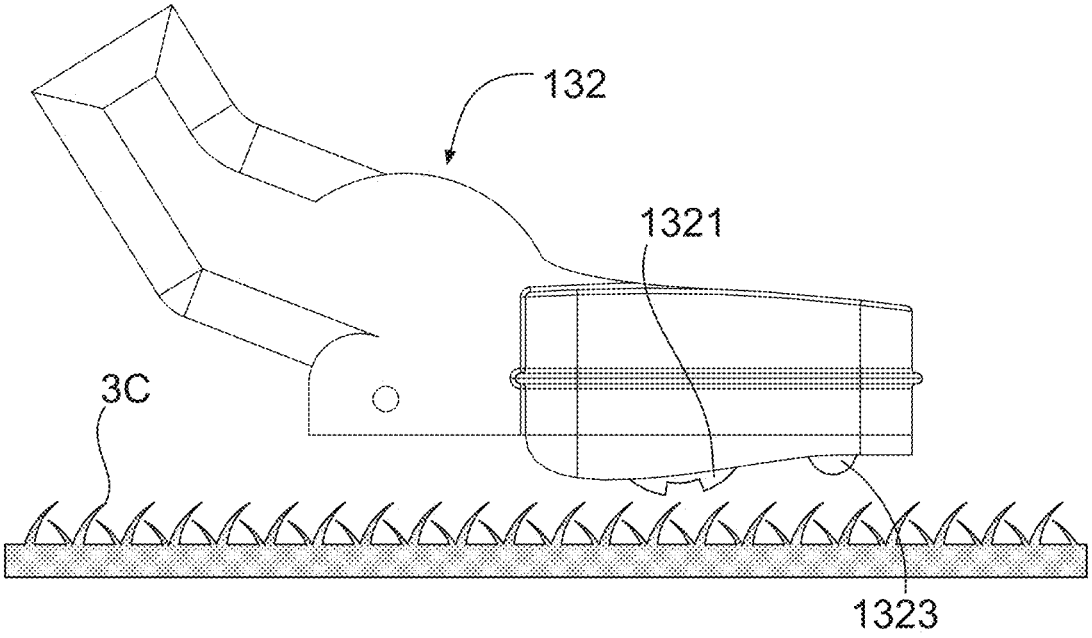
FIG. 8C shows a first side view of the dust suction device of the vacuum cleaner as shown in FIG. 4.

In addition, FIG. 8B illustrates a second side view of the dust suction device 13 of the vacuum cleaner 1 as shown in FIG. 4. As FIG. 8B and the dark gray dotted curve of FIG. 7 show, the main controlling unit 200 is also configured to perform a second function of (b) judging that the moved suction head 132 is on a floor 3B with short-pile-carpeted surface in case of the value of the first signal level falling in a second zone that is defined by the first threshold value and the second threshold value. FIG. 8C depicts a third side view of the dust suction device 13 of the vacuum cleaner 1 as shown in FIG. 4. Furthermore, As FIG. 8B and the dark gray dotted curve of FIG. 7 show, the main controlling unit 200 is also configured to perform a third function of (c) judging that the moved suction head 132 is on a floor 3C with long-pile-carpeted surface in case of the value of the first signal level falling in a third zone that is defined by the second threshold value and the third threshold value.

It should be understood that, when the suction head 123 is moved on the hard surfaced floor 3A along a first direction (like a forward-moving direction) and is continuously moved into a floor 3B with short-pile-carpeted surface, the first current sensed from the roller brush driving motor 1322 certainly shows a load effect (i.e., current variation), such that the main controlling unit 200 is able to achieve an floor identification according to the current variation. After judging that the suction head 132 is being moved from the hard surfaced floor 3A into the floor 3B with short-pile-carpeted surface, the main controlling unit 200 subsequently modulates the driving current (i.e., first current) for controlling an operation of the roller brush driving motor 1322, so as to properly change an rotation speed and/or an output torque of the roller brush driving motor 1322. In an exemplary embodiment, the main controlling unit 200 generates and transmits a PWM signal with a designated duty cycle to a switch element unit consists of IGBTs or MOSFETs to achieve a modulation of the driving current of the roller brush driving motor 1322, thereby changing the rotation speed and/or the output torque of the roller brush driving motor 1322.

It is worth noting that, FIG. 5 and FIG. 6 also depict that there is a direction sensor 22 integrated in the suction head 132. According to the present invention, the direction sensor 22 is used for completes a moving direction detection of the suction head 132 by detecting a rotation direction of an auxiliary wheel 1323 of the suction head 132. For example, if the direction sensor 22 detects the rotation direction of an auxiliary wheel 1323 so as to judge that the suction head 132 is being moved alone a forward-moving direction (i.e., first direction), the main controlling unit 200 would automatically defines that a backward-moving direction of the suction head 132 as a second direction. In other words, the first current sensing unit 21 detects a second current for controlling the operation of the roller brush driving motor 1322 in case of the suction head 132 being moved along the second direction, and then the first signal processing unit 202 processes the second current sensing signal to a second signal. As FIG. 7 show, the dark gray dotted curve is the first current (i.e., driving current) sensed from the roller brush driving motor 1322 in case of the suction head 132 is moved on floors 3A, 3B and 3C along the forward-moving direction (i.e., first direction). On the other hand, the dark curve is the second current (i.e., driving current) sensed from the roller brush driving motor 1322 in case of the suction head 132 is moved on floors 3A, 3B and 3C along the backward-moving direction (i.e., second direction).

As described in more detail below, according to the present invention, the plurality of reference parameters stored in the storage unit 201 further comprise: a first difference value, a second difference value and a third difference value. Moreover, the controlling and processing module 20 further comprises a second signal processing unit 203, wherein the second signal processing unit 203 is coupled to the main controlling unit 200 and the direction sensor 22 for receiving a moving direction sensing signal, so as to process the moving direction sensing signal to a moving direction signal. In one embodiment, the first signal processing unit 202 is an analog-to-digital convertor, and the second signal processing unit 203 is selected from a group consisting of digital-to-analog convertor and digital signal processor.

It is worth explaining that, in a practicable embodiment, the main controlling unit 200 can also be further configured to perform a fourth function of (d) stopping the operation of the roller brush driving motor in case of the value of the first signal level exceeding an overload limiting value.

As FIG. 7 show, the main controlling unit 200 is further configured to perform a fifth function of (e) judging that the moved suction head is on the hard surfaced floor 3A in case of a value difference between a value of a second signal level of the second signal and the value of the first signal level being less than the first difference value.

Moreover, the main controlling unit 200 can also be further configured to perform a sicth function of (f) judging that the moved suction head is on the floor 3B with short-pile-carpeted surface in case of the value difference being greater than the first difference value but less than the second difference value. Furthermore, the main controlling unit 200 is further configured to perform a seventh function of (g) judging that the moved suction head is on the floor 3C with long-pile-carpeted surface in case of the value difference being greater than the second difference value but less than the third difference value.

People ever used the vacuum cleaner 1 to execute a work of floor cleaning certainly know that, the suction head 132 would not be limited to be only moved on an identical type of floor like the hard surfaced floor 3A. It is easy to understood that, in case of the suction head 132 is always moved on an identical type of floor, the driving current for controlling the operation of the roller brush driving motor 1322 must be a constant current because a load effect response to the roller brush driving motor 1322 has no any variation. Therefore, it is imaginable that, after the suction head is moved from the hard surfaced floor 3A to the floor 3B with short-pile-carpeted surface, the load effect response to the roller brush driving motor 1322 must shows a significant variation, thereby causing a corresponding change of a value of the signal level of the driving current (i.e. the forgoing first current or second current).

Therefore, the present invention particularly lets the plurality of reference parameters stored in the storage unit 201 further comprise: a first difference value, a second difference value and a third difference value. Correspondingly, as FIG. 7 shows, the main controlling unit 200 is further configured to perform an eighth function of (h) judging that the moved suction head 132 is moved from the hard surfaced floor 3A into the floor 3B with short-pile-carpeted surface in case of the suction head 132 being moved along the first direction as well as the value of the first signal level falling in the first zone suddenly having a variation value greater than the first level variation value.

Moreover, the main controlling unit 200 is further configured to perform a ninth function of (i) judging that the moved suction head 132 is moved from the floor with short-pile-carpeted surface into the floor with long-pile-carpeted surface in case of the suction head 132 being moved along the first direction as well as the value of the first signal level falling in the second zone suddenly having a variation value greater than the second level variation value.

Furthermore, the main controlling unit 200 is further configured to perform a tenth function of (j) judging that the moved suction head 132 is moved from the floor with long-pile-carpeted surface into the floor with short-pile-carpeted surface in case of the suction head 132 being moved along the first direction as well as the value of the first signal level falling in the third zone suddenly having a variation value greater than the third level variation value. According to the present invention, the main controlling unit 200 can also be further configured to perform an eleventh function of (k) judging that the moved suction head 132 is moved from the floor with short-pile-carpeted surface into the hard surfaced floor in case of the suction head 132 being moved along the first direction as well as the value of the first signal level falling in the second zone suddenly having a variation value greater than the fourth level variation value.

Moreover, FIG. 6 further depicts that the floor types identifying device 2 of the present invention further comprises a second current sensing unit 23, which is coupled to a vacuum cleaner motor 111 disposed in the machine body 11, and is used for detecting a driving current for controlling an operation of the vacuum cleaner motor 111. Correspondingly, the controlling and processing unit 20 further comprises a third signal processing unit 204 coupled to the main controlling unit 200 and the second current sensing unit 23, wherein the third signal processing unit 204 is used for converting a driving current sensing signal received form the second current sensing unit 23 to a third signal.

It should be understood that, when the suction head 123 is moved on the hard surfaced floor 3A along a first direction (like a forward-moving direction) and is continuously moved into a floor 3B with short-pile-carpeted surface, the third current sensed from the vacuum cleaner motor 111 certainly shows a load effect (i.e., current variation), such that the main controlling unit 200 is able to achieve an floor identification according to the current variation. In such case, the main controlling unit 200 is able to modulates the driving current (i.e., third current) for controlling an operation of the vacuum cleaner motor 111, so as to properly change an rotation speed and/or an output torque of the vacuum cleaner motor 111. In an exemplary embodiment, the main controlling unit 200 generates and transmits a PWM signal with a designated duty cycle to a switch element unit consists of IGBTs or MOSFETs to achieve a modulation of the driving current of the vacuum cleaner motor 111, thereby changing the rotation speed and/or the output torque of the vacuum cleaner motor 111.

Figure 9:
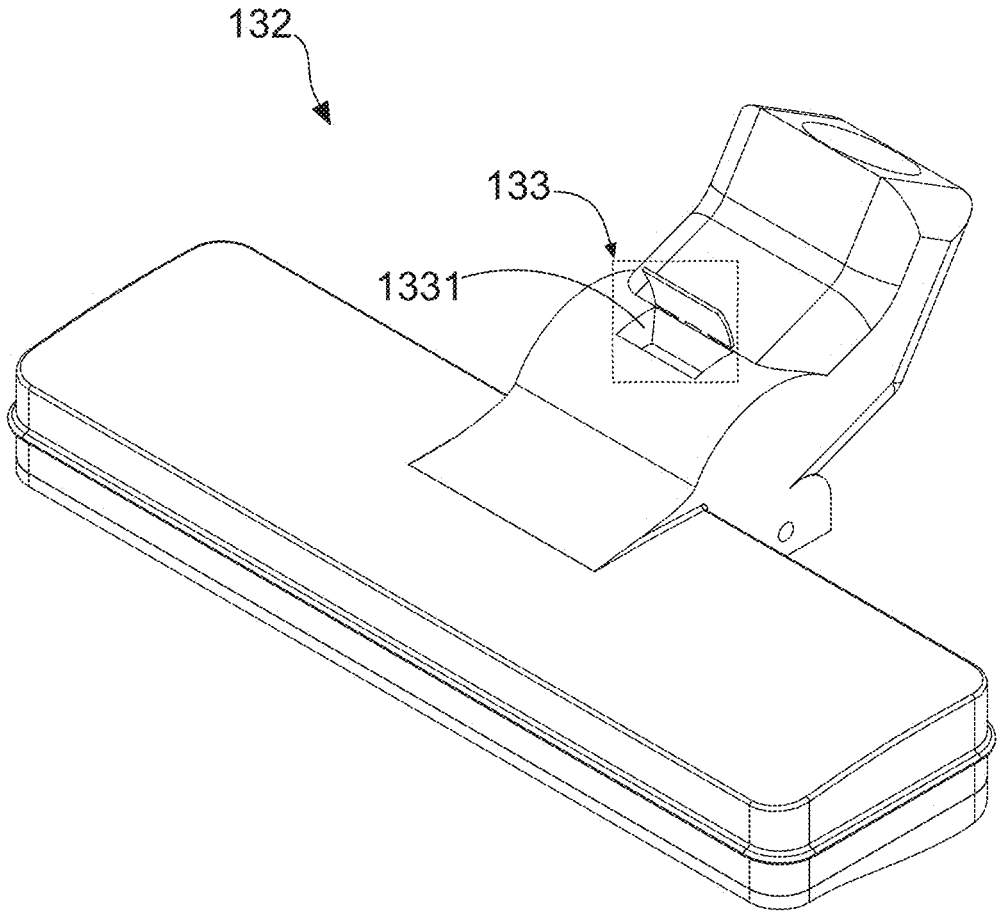
FIG. 9 shows a second stereo diagram of the dust suction device of the vacuum cleaner as shown in FIG. 4.

FIG. 9 shows a second stereo diagram of the dust suction device of the vacuum cleaner as shown in FIG. 4. In a practicable embodiment, dust suction device 13 of the vacuum cleaner 1 can be designed to further comprises an air aspiration adjusting unit 133. As FIG. 9 shows, the air aspiration adjusting unit 133 is disposed on the suction head 132 or the connection unit 131, and is used for adjusting an amount of air aspiration in an air channel connected between an extension connection unit 12 of a vacuum cleaner 1 and the connection unit 131. By such arrangement, when the suction head 123 is moved on the hard surfaced floor 3A along a forward-moving direction and is continuously moved into a floor 3B with short-pile-carpeted surface (or a floor 3C with long-pile-carpeted surface), the main controlling unit 200 is able to control the air aspiration adjusting unit 133 to adjust an amount of air aspiration in an air channel connected between an extension connection unit 12 of a vacuum cleaner 1 and the connection unit 131, thereby reducing the load effect variation response to the vacuum cleaner motor 111.

Therefore, through above descriptions, all embodiments and their constituting elements of the floor types identifying device for use in a dust suction device of a vacuum cleaner have been introduced completely and clearly. The above description is made on embodiments of the present invention. However, the embodiments are not intended to limit scope of the present invention, and all equivalent implementations or alterations within the spirit of the present invention still fall within the scope of the present invention.

What is claimed is:

1. A floor types identifying device, being applied in a vacuum cleaner comprises a machine body, an extension connection unit and a dust suction device, wherein the dust suction device comprises a suction head and a connection unit connected between the suction head and the extension connection unit, and the dust suction device comprising a roller brush and a roller brush driving motor; wherein the floor types identifying device comprises:

a first current sensing unit, being coupled to the roller brush driving motor, and being used to detect a first current for controlling an operation of the roller brush driving motor in case of the suction head being moved along a first direction, thereby outputting a first current sensing signal;

a direction sensor, being integrated in the suction head, and being used for detecting a forward-moving direction and a backward-moving direction of the suction head so as to generate a moving direction sensing signal; and a controlling and processing module, being coupled to the first current sensing unit, the direction sensor and the roller brush driving motor, and comprising:

a storage unit, being stored with a plurality of reference parameters that comprises: a base value, a first threshold value greater than the base value, a second threshold value greater than the first threshold, a third threshold value greater than the second threshold value, a first difference value, a second first difference value, and a third first difference value;

a first signal processing unit, being coupled to the first current sensing unit for receiving the first current sensing signal, so as to process the first current sensing signal to a first signal;

a second signal processing unit, being coupled to the direction sensor for receiving the moving direction sensing signal, and processing the moving direction sensing signal to a moving direction signal; and a main controlling unit, being coupled to the storage unit, the first signal processing unit for receiving the first signal and the second signal processing unit for receiving the moving direction signal, and being configured to perform a plurality of functions, comprising:

(a) judging that the moved suction head is on a hard surfaced floor in case of a value of a first signal level of the first signal falling in a first zone that is defined by the base value and the first threshold value;

(b) judging that the moved suction head is on a floor with short-pile-carpeted surface in case of the value of the first signal level falling in a second zone that is defined by the first threshold value and the second threshold value;

(c) judging that the moved suction head is on a floor with long-pile-carpeted surface in case of the value of the first signal level falling in a third zone that is defined by the second threshold value and the third threshold value;

(d) in case the moving direction signal indicating that the suction head is moving along a second direction contrary to the first direction, enabling the first signal processing unit to receive a second current sensing signal from the first current sensing unit, so as generate a second signal;

(e) judging that the suction head is on the hard surfaced floor in case of a value difference between a value of a second signal level of the second signal and the value of the first signal level being less than the first difference value;

(f) judging that the suction head is on the floor with short-pile-carpeted surface in case of the value difference being greater than the first difference value but less than the second difference value; and (g) judging that the suction head is on the floor with long-pile-carpeted surface in case of the value difference being greater than the second difference value but less than the third difference value.

2. The floor types identifying device of claim 1, wherein the plurality of functions further comprise:

(h) stopping the operation of the roller brush driving motor in case of the value of the first signal level exceeding an overload limiting value.

3. The floor types identifying device of claim 1, wherein the first direction and the second direction are the forward-moving direction and the backward-moving direction, respectively.

4. The floor types identifying device of claim 1, wherein the first direction and the second direction are the backward-moving direction and the forward-moving direction, respectively.

5. The floor types identifying device of claim 1, wherein the direction sensor completes a moving direction detection of the suction head by detecting a rotation direction of an auxiliary wheel of the suction head.

6. The floor types identifying device of claim 5, wherein the plurality of reference parameters further comprises a first level variation value, a second level variation value, a third level variation value, and a fourth level variation value.

7. The floor types identifying device of claim 6, wherein the plurality of functions further comprise:

(i) judging that the moved suction head is moved from the hard surfaced floor into the floor with short-pile-carpeted surface in case of the suction head being moved along the first direction as well as the value of the first signal level falling in the first zone suddenly having a variation value greater than the first level variation value; and (j) judging that the moved suction head is moved from the floor with short-pile-carpeted surface into the floor with long-pile-carpeted surface in case of the suction head being moved along the first direction as well as the value of the first signal level falling in the second zone suddenly having a variation value greater than the second level variation value.

8. The floor types identifying device of claim 6, wherein the plurality of functions further comprise:

(k) judging that the moved suction head is moved from the floor with long-pile-carpeted surface into the floor with short-pile-carpeted surface in case of the suction head being moved along the first direction as well as the value of the first signal level falling in the third zone suddenly having a variation value greater than the third level variation value; and (l) judging that the moved suction head is moved from the floor with short-pile-carpeted surface into the hard surfaced floor in case of the suction head being moved along the first direction as well as the value of the first signal level falling in the second zone suddenly having a variation value greater than the fourth level variation value.

9. The floor types identifying device of claim 5, further comprising a second current sensing unit, being coupled to a vacuum cleaner motor disposed in the machine body, and being used for detecting a driving current for controlling an operation of the vacuum cleaner motor.

10. The floor types identifying device of claim 5, wherein the controlling and processing unit further comprises a third signal processing unit coupled to the main controlling unit and the second current sensing unit, and the third signal processing unit being used for converting a driving current sensing signal received form the second current sensing unit to a third signal.

11. The floor types identifying device of claim 10, wherein the first signal processing unit is an analog-to-digital convertor, and the second signal processing unit being selected from a group consisting of digital-to-analog convertor and digital signal processor.

12. A dust suction device comprising a suction head and a connection unit disposed on the suction head, characterized in that the dust suction device further comprises a floor types identifying device, and the floor types identifying device comprising:

a first current sensing unit, being coupled to the roller brush driving motor, and being used to detect a first current for controlling an operation of the roller brush driving motor in case of the suction head being moved along a first direction, thereby outputting a first current sensing signal;

a direction sensor, being integrated in the suction head, and being used for detecting a forward-moving direction and a backward-moving direction of the suction head so as to generate a moving direction sensing signal; and a controlling and processing module, being coupled to the first current sensing unit, the direction sensor and the roller brush driving motor, and comprising:

a storage unit, being stored with a plurality of reference parameters that comprises: a base value, a first threshold value greater than the base value, a second threshold value greater than the first threshold, a third threshold value greater than the second threshold value, a first difference value, a second first difference value, and a third first difference value;

a first signal processing unit, being coupled to the first current sensing unit for receiving the first current sensing signal, so as to process the first current sensing signal to a first signal;

a second signal processing unit, being coupled to the direction sensor for receiving the moving direction sensing signal, and processing the moving direction sensing signal to a moving direction signal; and a main controlling unit, being coupled to the storage unit, the first signal processing unit for receiving the first signal and the second signal processing unit for receiving the moving direction signal, and being configured to perform a plurality of functions, comprising:

(a) judging that the moved suction head is on a hard surfaced floor in case of a value of a first signal level of the first signal falling in a first zone that is defined by the base value and the first threshold value;

(b) judging that the moved suction head is on a floor with short-pile-carpeted surface in case of the value of the first signal level falling in a second zone that is defined by the first threshold value and the second threshold value;

(c) judging that the moved suction head is on a floor with long-pile-carpeted surface in case of the value of the first signal level falling in a third zone that is defined by the second threshold value and the third threshold value;

(d) in case the moving direction signal indicating that the suction head is moving along a second direction contrary to the first direction, enabling the first signal processing unit to receive a second current sensing signal from the first current sensing unit, so as to generate a second signal;

(e) judging that the suction head is on the hard surfaced floor in case of a value difference between a value of a second signal level of the second signal and the value of the first signal level being less than the first difference value;

(f) judging that the suction head is on the floor with short-pile-carpeted surface in case of the value difference being greater than the first difference value but less than the second difference value; and (g) judging that the suction head is on the floor with long-pile-carpeted surface in case of the value difference being greater than the second difference value but less than the third difference value.

13. The dust suction device of claim 12, further comprising an air aspiration adjusting unit, being disposed on the suction head or the connection unit, and being used for adjusting an amount of air aspiration in an air channel connected between an extension connection unit of a vacuum cleaner and the connection unit.

14. A vacuum cleaner comprising a machine body, an extension connection unit and a dust suction device, characterized in that the dust suction device in integrated with a floor types identifying device, and the floor types identifying device comprising:

a first current sensing unit, being coupled to the roller brush driving motor, and being used to detect a first current for controlling an operation of the roller brush driving motor in case of the suction head being moved along a first direction, thereby outputting a first current sensing signal;

a direction sensor, being integrated in the suction head, and being used for detecting a forward-moving direction and a backward-moving direction of the suction head so as to generate a moving direction sensing signal; and a controlling and processing module, being coupled to the first current sensing unit, the direction sensor and the roller brush driving motor, and comprising:

a storage unit, being stored with a plurality of reference parameters that comprises: a base value, a first threshold value greater than the base value, a second threshold value greater than the first threshold value, a third threshold value greater than the second threshold value, a first difference value, a second first difference value, and a third first difference value;

a first signal processing unit, being coupled to the first current sensing unit for receiving the first current sensing signal, so as to process the first current sensing signal to a first signal;

a second signal processing unit, being coupled to the direction sensor for receiving the moving direction sensing signal, and processing the moving direction sensing signal to a moving direction signal; and a main controlling unit, being coupled to the storage unit, the first signal processing unit for receiving the first signal and the second signal processing unit for receiving the moving direction signal, and being configured to perform a plurality of functions, comprising:

(a) judging that the moved suction head is on a hard surfaced floor in case of a value of a first signal level of the first signal falling in a first zone that is defined by the base value and the first threshold value;

(b) judging that the moved suction head is on a floor with short-pile-carpeted surface in case of the value of the first signal level falling in a second zone that is defined by the first threshold value and the second threshold value;

(c) judging that the moved suction head is on a floor with long-pile-carpeted surface in case of the value of the first signal level falling in a third zone that is defined by the second threshold value and the third threshold value;

(d) in case the moving direction signal indicating that the suction head is moving along a second direction contrary to the first direction, enabling the first signal processing unit to receive a second current sensing signal from the first current sensing unit, so as to generate a second signal;

(e) judging that the suction head is on the hard surfaced floor in case of a value difference between a value of a second signal level of the second signal and the value of the first signal level being less than the first difference value;

(f) judging that the suction head is on the floor with short-pile-carpeted surface in case of the value difference being greater than the first difference value but less than the second difference value; and (g) judging that the suction head is on the floor with long-pile-carpeted surface in case of the value difference being greater than the second difference value but less than the third difference value.

* * * * *